US005325714A

United States Patent [19]

Lende et al.

[11] Patent Number: 5,325,714

[45] Date of Patent: Jul. 5, 1994

[54] STEERABLE MOTOR SYSTEM WITH INTEGRATED FORMATION EVALUATION LOGGING CAPACITY

[75] Inventors: Bjorn Lende, Stavanger; Anders K. Nesheim, Bru; Nils Reimers, Stavanger; Sigurd Solem, Randaberg, all of Norway

[73] Assignee: Baker Hughes Incorporated, Houston, Tex.

[21] Appl. No.: 60,563

[22] Filed: May 12, 1993

[51] Int. Cl.[5] ..... E21B 47/00; G01V 3/18

[52] U.S. Cl. ..... 73/153; 367/25; 367/911; 175/61; 175/73; 175/74; 175/75; 73/151; 73/155; 166/358; 166/349

[58] Field of Search ..... 73/151, 155; 116/358, 116/349; 175/61, 73, 74, 75, 76; 367/25, 911; 166/316

[56] References Cited

U.S. PATENT DOCUMENTS

| | | | |
|---|---|---|---|
| 3,958,217 | 5/1976 | Spinnler | 340/18 LD |
| 4,492,276 | 1/1985 | Kamp | 175/61 |
| 4,570,123 | 2/1986 | Grosso | 324/369 |
| 4,575,681 | 3/1986 | Grosso et al. | 324/347 |
| 4,577,701 | 3/1986 | Dellinger et al. | 175/61 |
| 4,697,650 | 10/1987 | Fontenot | 73/151.5 |
| 4,697,651 | 10/1987 | Dellinger | 175/61 |
| 4,729,675 | 3/1988 | Trzeciak et al. | 384/91 |
| 4,786,874 | 11/1988 | Grosso et al. | 324/369 |
| 4,796,186 | 1/1989 | Kaufman | 73/151.5 |
| 4,880,066 | 11/1989 | Steiginga et al. | 175/76 |
| 4,982,801 | 1/1991 | Zitka et al. | 173/163 |
| 5,001,675 | 3/1991 | Woodward | 367/13 |
| 5,074,681 | 12/1991 | Turner et al. | 364/613 |
| 5,083,124 | 1/1992 | Nordstrom | 250/262 |
| 5,126,564 | 6/1992 | Perry et al. | 250/254 |
| 5,134,285 | 7/1992 | Perry et al. | 250/269 |
| 5,135,059 | 8/1992 | Turner et al. | 175/101 |
| 5,139,094 | 8/1992 | Prevedel et al. | 175/61 |
| 5,144,126 | 9/1992 | Perry et al. | 250/254 |
| 5,212,495 | 5/1993 | Winkel et al. | 324/338 |

*Primary Examiner*—Hezron E. Williams
*Assistant Examiner*—J. David Wiggins
*Attorney, Agent, or Firm*—Fishman, Dionne and Cantor

[57] ABSTRACT

A steerable motor system with integrated formation evaluation logging capacity is presented. The device comprises a housing, a formation resistivity logging tool, a surface signaling device, a density logging tool, a porosity logging tool and a downhole motor and drill. The formation resistivity logging tool is located below the downhole motor and is mounted within the housing wherethrough a drive shaft, extending from the downhole motor, is disposed. Power and signal cables are located within an outer shell of the housing and connect the surface signaling device with the resistivity logging tool. In an alternate embodiment, the resistivity logging tool is located between a motor stabilizer and the drill bit. The present invention allows for increased drill angle during wellbore drilling and formation evaluation.

23 Claims, 3 Drawing Sheets

STEERABLE MOTOR SYSTEM WITH INTEGRATED FORMATION EVALUATION LOGGING CAPACITY

BACKGROUND OF THE INVENTION

The present invention relates to devices for downhole drilling and, more particularly, to steerable motor drives with formation evaluation capability.

Downhole drilling devices of the positive displacement type are well known. For example, U.S. Pat. No. 5,135,059, which is assigned to the assignee hereof and the disclosure of which is incorporated herein by reference, discloses a downhole drill which includes a housing, a stator having a helically contoured inner surface secured within the housing and a rotor having a helically contoured exterior surface disposed within the stator. Drilling fluid (e.g., drilling mud) is pumped through the stator which causes the rotor to move in a planetary type motion about the inside surface of the stator. A drive shaft is connected to the rotor via a flexible coupling to compensate for the eccentric movement of the rotor. Other examples of downhole drilling devices are disclosed in U.S. Pat. Nos. 4,729,675, 4,982,801 and 5,074,681 the disclosure of each of which are incorporated herein by reference.

Formation evaluation tools assist operators in identifying the particular geological material through which a drill is passing. This feedback of information is used by operators to direct the drilling of a well, through, in the case of a horizontal well, a desired layer or stratum without deviating therefrom. These tools have employed several techniques in the past which have been used independently and/or in some combination thereof. Formation resistivity, density and porosity logging are three well known techniques. One resistivity measuring device is described in U.S. Pat. No. 5,001,675 which is assigned to the assignee hereof and is incorporated herein by reference. This patent describes a dual propagation resistivity (DPR) device having one or more pairs of transmitting antennas spaced from one or more pairs of receiving antennas. Magnetic dipoles are employed which operate in the mf and lower hf spectrum. In operation, an electromagnetic wave is propagated from the transmitting antenna into the formation surrounding the borehole and is detected as it passes by the two receiving antennas. The phase and the amplitude are measured in a first or far receiving antenna which is compared to the phase and amplitude received in a second or near receiving antenna. Resistivities are derived from the phase differences and the amplitude ratio of the received signals. The formation evaluation of DPR tool communicates the resistivity data and then transmits this information to the drilling operator using mud pulse telemetry. Other examples of DPR units are disclosed in U.S. Pat. Nos. 4,786,874, 4,575,681 and 4,570,123.

Formation density logging devices, such as that described in U.S. Pat. No. 5,134,285 which is assigned to the assignee hereof and the disclosure of which is incorporated herein by reference, typically employ a gamma ray source and a detector. In use, gamma rays are emitted from the source, enter the formation to be studied, and interact with the atomic electrons of the material of the formation and the attenuation thereof is measured by the detector and from this the density of the formation is determined.

A formation porosity measurement device, such as that described in U.S. Pat. No. 5,144,126 which is assigned to the assignee hereof and fully incorporated herein by reference, include a neutron emission source and a detector. In use, high energy neutrons are emitted into the surrounding formation and the detectors measure neutron energy depletion due to the presence of hydrogen in the formation. Other examples of nuclear logging devices are disclosed in U.S. Pat. Nos. 5,126,564 and 5,083,124.

In directional drilling (e.g., a horizontal well), it is desired to maintain the wellbore within the pay zone (i.e., a selected bed or stratum) for as long as possible since the desired raw material may be laterally displaced throughout the strata. Therefore, a higher recovery of that material occurs when drilling laterally through the stratum. The drill bit is typically steered through the pay zone by rotating the drill collar which, because of a small bend in the lower portion of the drill collar, will turn the drill bit into a different direction. However, the distance between the DPR sensor and the bit (e.g., generally in excess of four feet) requires the wellbore to be drilled at a minimal angle with respect to the longitudinal direction of the pay-zone, otherwise the drill bit may enter a different zone long before the DPR sensor would recognize that fact. In the situation where the adjacent zone includes water, a potential problem becomes more readily apparent.

In drilling apparatus all three of these tools for evaluating a formation may be employed downhole in a drill housing or segment. The most effective at determining whether there is a change in strata ahead of the drill bit, e.g., oil water contact, is the resistivity logging device. Oil, water contact for example has a resistivity change of 100 ohms per meter away from the low resistance side of the contact point. However, in the past, excessive spacing between the resistivity measuring (or logging) device and the bit prevented accurate readings as previously discussed. Unfortunately, the resistivity measuring device could not be located close to the bit because of the use of conventional mud motors and stabilization displacing the resistivity sensor 25' from the bit at minimum.

SUMMARY OF THE INVENTION

The above-discussed and other drawbacks and deficiencies of the prior art are overcome or alleviated by the steerable motor system of the present invention. In accordance with the present invention, a steerable motor system having a downhole motor e.g., a positive displacement Moineau (PDM) motor is provided with a formation resistivity logging tool e.g., a dual propagation resistivity (DPR) device and a surface signaling device. The DPR unit is preferably located between the PDM and a motor stabilizing bearing section. A density logging device and a porosity measuring device may also be disposed uphole of the surface signaling device.

The DPR unit is mounted within a drill collar segment or housing and includes a transmitting means and a receiving means. To communicate with the surface signaling device, and for energizing the DPR, electrical cables are provided. These power and signal cables pass through conduits located in the outer housing of the PDM. A drive shaft extends axially through the housing of the DPR unit to interconnect the downhole motor with the drill bit. The surface signaling device may also be interconnected with the density and porosity measuring devices for communicating formation parameters to the surface via such means as mud pulse or acoustic telemetry.

A motor stabilizer, a density logging device stabilizer and a near bit stabilizer are disposed along the outside of the housing. These stabilizers provide additional control over the drill string.

In an alternate embodiment, the DPR may be located between the motor stabilizer and the bit box. This will provide an even closer proximity to the bit, thereby further increasing the drill angle. This is not the preferred arrangement because of the common need for a stabilizer close to the bit to centralize the drill-bit action when the system is rotated from surface.

The present invention has numerous features and advantages relative to the prior art which includes formation evaluation by resistivity located closer to the drill bit giving increased control over the drill string. Other advantages include a drilling angle of 80°-85°, wherein the resistivity measurements will be deeper than the drill bit when drilling from low resistivity to highly resistive zones. Another feature includes the absence of a need for a pilot hole when the pay zone true vertical depth (TVD) is known within 50 feet.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
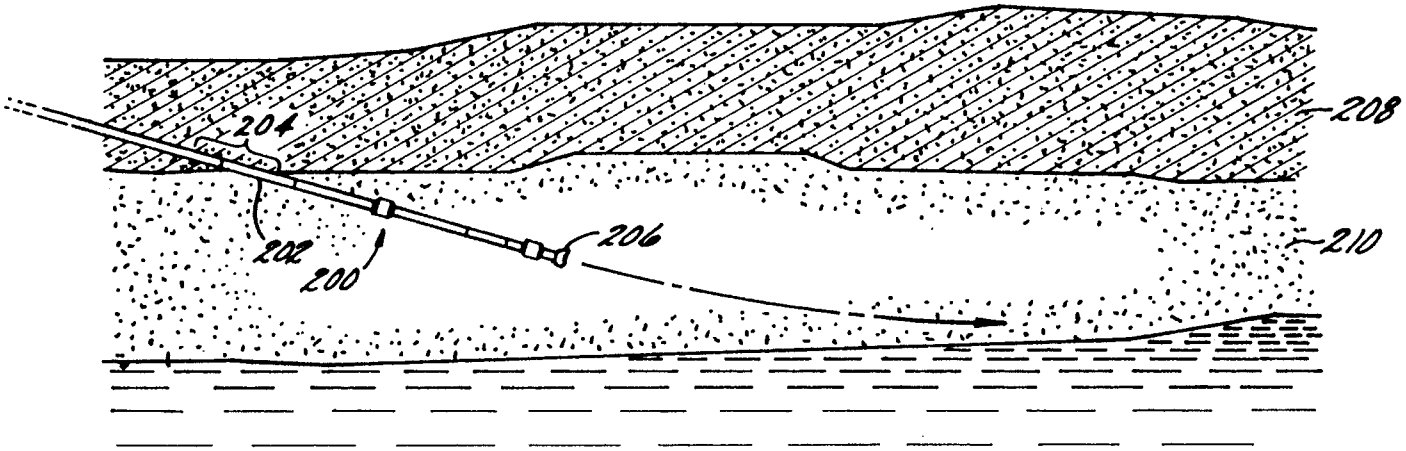
FIG. 1 (PRIOR ART)
FIG. 1 is a schematic diagram of a prior art drill string drilling through a formation.

Referring to FIG. 1, a prior art drill string is shown generally at 200. Drill string 200 includes a resistivity logging device 202 having an approximate range designated by a bracket 204 which varies according to the resistance of the material traversed and is circumferentially spaced about the drill string. A drill bit 206 is provided at the lower end of drill string 200 for drilling the formation. As is readily apparent, drill bit 206 is disposed well ahead of the stratum which is being sensed by the resistivity logging device 202. This position of the resistivity logging device 202 prevents uphole operators from changing the direction of the drill bit 206 before it has drilled into a different zone. As illustrated here the drill bit 206 has drilled through a zone of shale 208 and is currently disposed well within a zone of sand 210. The resistivity logging device 202 has just begun to detect the next zone of material i.e., the sand 210. This placement of the resistivity logging device in past devices was due to the use of conventional mud motors and stabilization displacing the resistivity sensor 25' from the bit at minimum.

Figure 2:
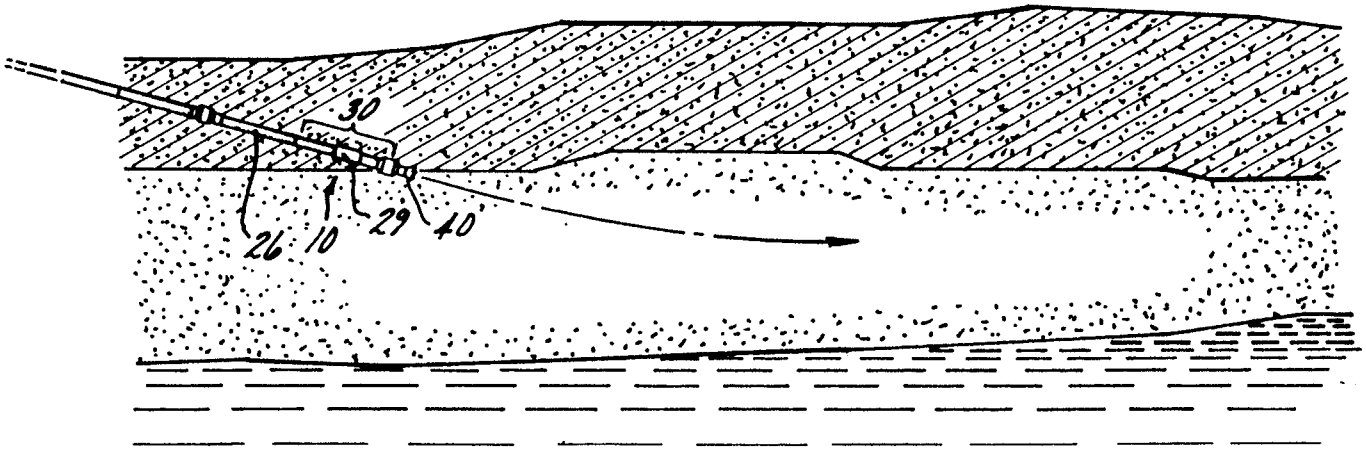
FIG. 2 is a schematic diagram of a drill string in accordance with the present invention drilling through the formation of FIG. 1.

Referring to FIG. 2, a steerable motor system with integrated formation evaluation resistivity logging capacity according to the present invention is shown generally at 10. The motor system 10 is mounted within a housing or drill collar 12 which is generally tubular in shape and is segmented by a threaded sleeve 14 (FIG. 4A) and a glued sleeve 16 (FIG. 4B) for ease of assembly and disassembly. The motor system 10 comprises a downhole motor 26, a surface signaling device 28 and a resistivity logging device 29. A bracket 30 illustrates an approximate range of resistivity logging device 29.

Figure 5:
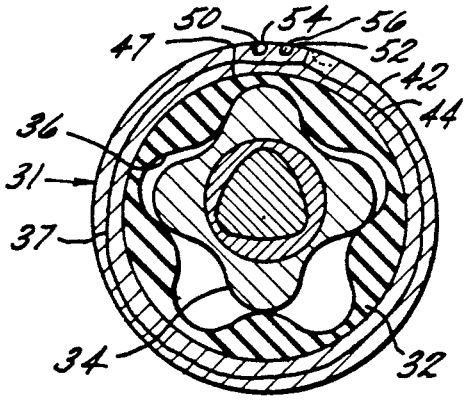
FIG. 5 is an enlarged cross sectional view taken along the line 5—5 of FIG. 4B.
Figure 4A:
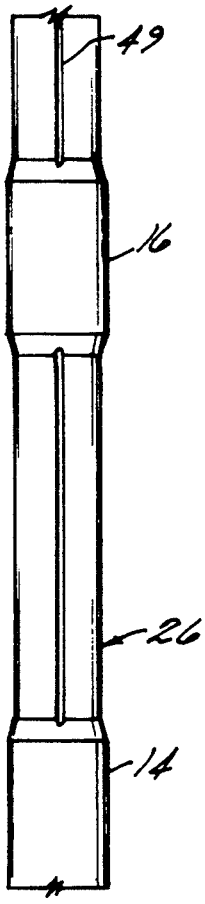
FIG. 4A is a plan view showing the outer casing of a downhole motor in accordance with the present invention.
Figure 4B:
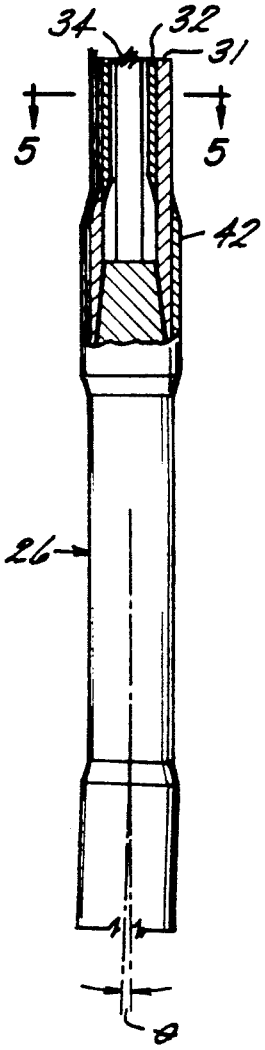
FIG. 4B is a side view, partially broken away, showing the downhole motor.

As depicted in FIGS. 4A, 4B and 5, downhole motor 26 is preferably a positive displacement type.(e.g., the positive displacement motor described in U.S. Pat. No. 5,135,059), although, it will be appreciated that any suitable motor may be employed. Motor 26 includes a housing 31, a stator 32 and a rotor 34. The stator 32 includes a helically contoured inner surface 36 and the rotor 34 has a helically contoured outer surface 37 (FIG. 5). A central drive shaft 38 (FIG. 6) is connected to rotor 34 by means of a flexible shaft (not shown). A drill bit 40 (FIG. 2) is provided at the lower end of housing 12 and receives rotary motion from drive shaft 38. When drilling fluid flows between rotor 34 and stator 32, rotor 34 is driven in a planetary motion about .the inner surface 36 of stator 32 thereby providing a rotary motion to drive shaft 38, and, in turn, rotating the drill bit 40. For directional steering of the drill string, housing 12 may have a slight bend shown as angle $\theta$ (FIG. 4B) e.g., 1°.

As best shown in FIG. 5, housing 31 includes a protective sleeve 42 which surrounds a stator housing 44. Protective sleeve 42 has a groove 49 wherein a pair of longitudinal tubes 50 and 52 are located. Disposed within these tubes 50 and 52 are power cables 54 and signal cables 56 which will be more fully described hereinafter. In another position, not shown, tubes 50 and 52 are located within the body of stator 32 adjacent the housing 44.

Figure 3:
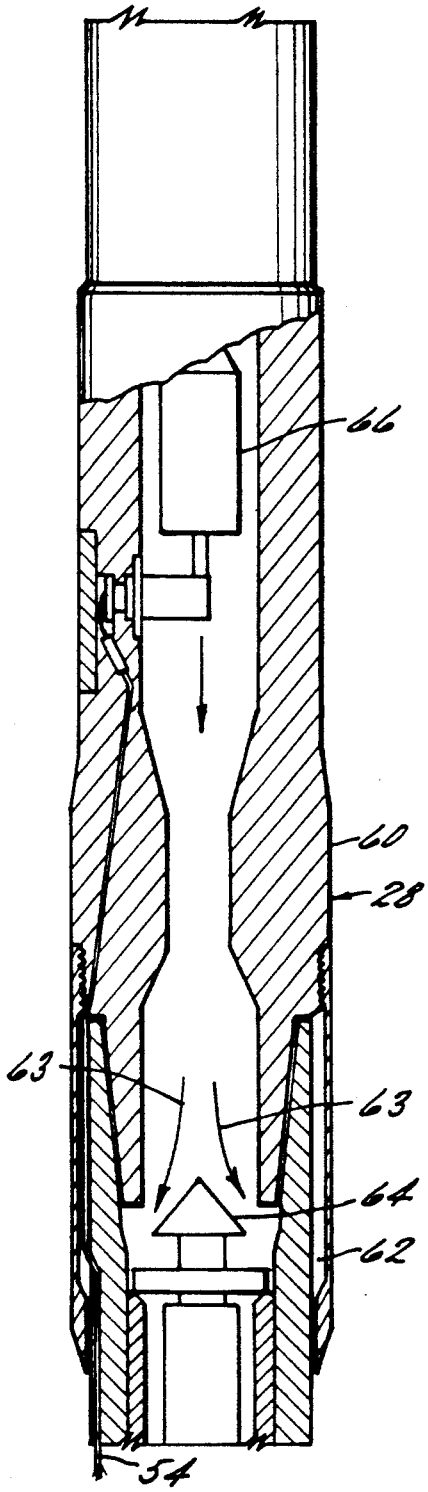
FIG. 3 in an enlarged side view, partially broken away, showing the top of the motor section in accordance with the present invention.

Referring now to FIG. 3, by way of example, surface signaling device 28 is shown as a mud pulse transmitter (e.g., the mud pulse transmitter described in U.S. Pat. No. 3,958,217 which is incorporated herein by reference), however, any suitable device for receiving resistivity or permitivity data from the transmitting (e.g., an acoustic transmitter for acoustic telemetry) resistivity logging device 29 (FIG. 2) may be employed. Further, such formation data may be stored in a memory device for later retrieval as is well known. Signaling device 28 comprises a pair of interconnected housings or drill collar segments 60 and 62. A mud pulser 64 is located within a mud stream (the direction of which is indicated by arrows 63) for signaling the surface by generating positive pulses in the mud stream. It will be appreciated that negative mud pulse telemetry may also be employed, as is well known. These pulses are received upstream by a transducer (not shown) and converted to a format for review by an operator as is well known. Power and signal cables 54, 56 are interconnected with mud pulser 64 and a standard coil 66 which functions to sense rotation in the drill string for actuating the measurement while drilling (MWD) system. It will be appreciated that power cable 54 is energized by a turbine driven generator (not shown); the turbine being rotated by the flow of drilling fluid as is well known.

Figure 6:
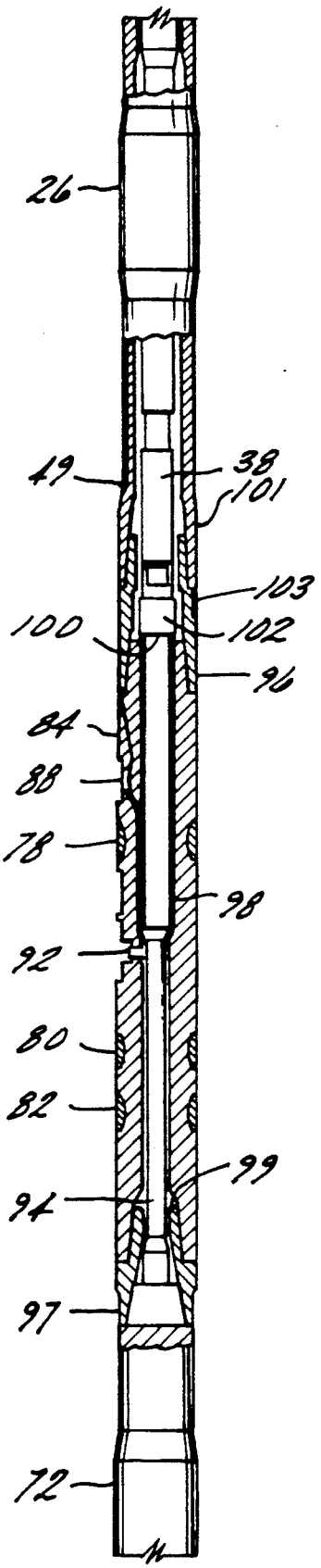
FIG. 6 is a side elevational view, partly in section, showing the resistivity logging device of FIG. 2 interconnected with the downhole motor.

Referring now to FIG. 6, resistivity logging device 29 is illustrated as a dual propagation resistivity (DPR) tool 70 which is located between a motor stabilizer 72 and a bearing pack 101. The DPR tool 70 includes antenna covers 78, 80 and 82 which may be those described in U.S. patent application Ser. No. 558,075 filed Jul. 25, 1990, assigned to the assignee hereof and incorporated herein by reference. Mounted below cover 78 is a transmitting antenna and below each cover 80 and 82 is a receiving antenna (not shown). The antennas are preferably the antennas that are described in U.S. Pat. No. 5,001,675, although other known antennas may be employed. Transmitter and receiver means (also not shown) are located within the DPR tool 70 as is known. Longitudinal groove 49 and tubes 50 and 52 of downhole motor 26 communicate with bores 84 and 86 (not shown) of DPR tool 70. Power and signal cables 54 and 56 extend through bores 84 and 86 and are interconnected with the transmitter and receiver means in tool 70. A junction 88 is provided under a hatch cover 90 on tool 70 wherein signal and power cables 54 and 56 pass. A coil plug 92 is also employed and it functions to bring signal and power leads 54 and 56 to the inner bore of the device, allowing passage to the upper end-connection hatch.

In accordance with an important feature of the present invention, DPR tool 70 includes a drive shaft segment 94, which is provided for interconnecting the PDM 26 with the motor stabilizer 72 and extends through the central axis of the DPR 70. Drive shaft segment 94 terminates in a connector 97 at the motor stabilizer 72. Crossover 96 is provided for joining the DPR tool 70 to the PDM 26. Radial bearing 98 is disposed about the drive shaft segment 94 and drive shaft cap 100 engages a socket 102 of the bearing pack 101 and sleeve 103 secures the bearing pack in place. This simultaneously provides sufficient bearing under the universal joint and limits heat transfer to and from the drive shaft.

Figure 7:
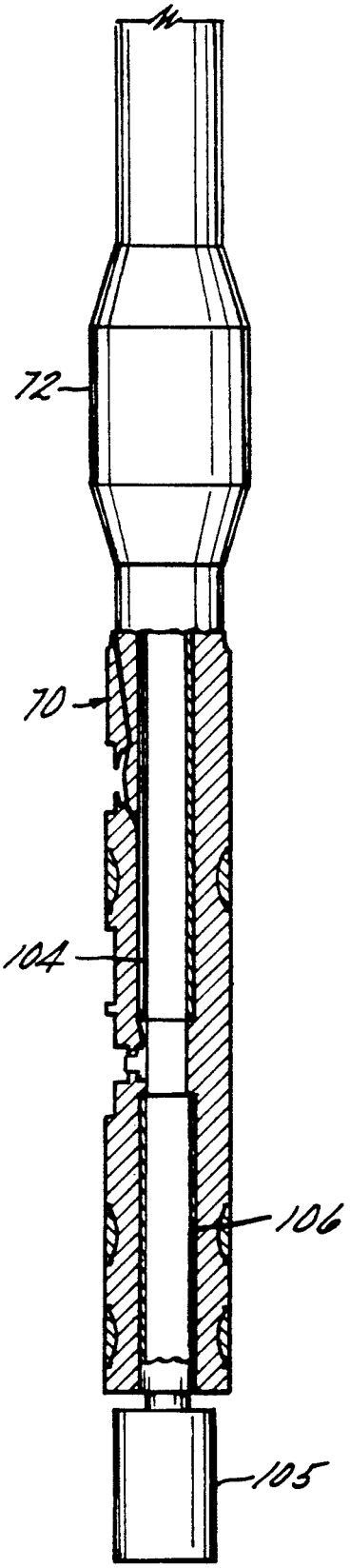
FIG. 7 is a side elevational view, partly in section, of an alternate embodiment of the device of FIG. 2.

In an alternate embodiment as illustrated in FIG. 7, the DPR 70, which may be essentially similar to that previously described is mounted downhole of the motor stabilizer 72 and adjacent to a bit box 105. In this embodiment, a pair of radial bearings 104 and 106 are provided for allowing proper rotation of the drive shaft 38 which, as previously described, extends through the central portion of the DPR 70. It will be understood that the motor stabilizer 72 includes a pair of longitudinal bores (not shown) for passage of the cables 54 and 56. This placement of the DPR unit has specific application where very high curvatures are to be drilled and rotation of the system is not permitted.

In accordance with another feature of this invention a plurality of stabilizers are arranged along the housing 12 of the drillstring 10. Examples include a motor stabilizer and a near bit stabilizer. Other examples include non-stabilized assembly and double bend assembly. Each of which function to measure the formation density ,such measurement made with the stand-off stabilizer used as stabilization on the top of the motor. The proper arrangement of stabilizer combines a formation density measurement device with the function of an active stabilizer to minimize friction when the system is slid through earth strata.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A measurement-while-drilling (MWD) formation evaluation tool mounted on a drill string and disposed between a drill bit and a drill motor, the drill motor for rotating the drill bit, comprising:

housing means having an axial opening therethrough, said housing means having first and second opposed ends with said first end being adapted for connection to the drill bit and said second end being adapted for connection to the drill motor;

at least one formation resistivity logging means being supported by said housing means;

shaft means disposed within said axial opening of said housing means, said shaft means transmitting rotation from the drill motor to the drill bit, said shaft means having first and second opposed ends with said first end being adapted for connection to the drill bit and the second end being adapted for connection to the drill motor.

2. The device of claim 1 including stabilizer means mounted on said housing means.

3. The device of claim 2 wherein:

said stabilizer means is mounted above said resistivity logging means.

4. The device of claim 2 wherein:

said stabilizer means is mounted below said resistivity logging means.

5. The device of claim 1 further including:

surface signaling means interconnected with said resistivity logging means.

6. The device of claim 5 wherein:

said drill motor includes a longitudinal groove extending along a portion of an outer surface of said drill motor.

7. The device of claim 6 including:

at least one tube disposed within said groove.

8. The device of claim 7 further including:

cable means extending through said tube, said cable means interconnecting said formation evaluation device and said surface signaling device for transference of said signals therebetween.

9. The device of claim 5 wherein said drill motor includes:

a stator mounted within said housing, said stator having a helically grooved inner surface;

a rotor disposed within said stator, said rotor having a grooved outer surface and adapted to rotate about the inside surface of said stator; and a flexible connector interconnecting said rotor and said shaft means.

10. The device of claim 9 further comprising:

a sleeve disposed about said stator, said sleeve including at least one tube disposed longitudinally therethrough.

11. The device of claim 10 further including:

cable means extending through said tube, said cable means interconnecting said formation evaluation device and said surface signaling device for transference of said signals therebetween.

12. The device of claim 1 wherein said resistivity measuring means includes:

transmitting means for transmitting in-phase, equal amplitude reference signals;

a transmitting antenna normally connected to said transmitting means;

sensing means for sensing said reference signals;

a pair of spaced receiving antennas connected to said sensing means; and microprocessor means for calculating a difference in phase and amplitude between said reference signals received by said receiving antennas.

13. The device of claim 7 wherein:

said at least one tube comprises a pair of tubes.

14. The device of claim 1 further including:

density measuring means mounted on said drill string uphole of said downhole motor.

15. The device of claim 14 further including:

porosity measuring means mounted on said drill string uphole of said density measuring means.

16. A steerable motor system with an integrated formation evaluation device for drilling a well or the like below ground level having an uphole portion close to said ground level and a downhole portion disposed distal to said ground level comprising:

a housing;

a drive shaft disposed through a portion of said housing, said drive shaft located along the central axis of said housing;

a downhole motor mounted within said housing, said downhole motor drivingly engaging said drive shaft;

means for stabilizing said downhole motor being mounted uphole of said bit;

a resistivity measuring device mounted within said housing between said means for stabilizing said bit and said downhole motor, said formation evaluation device adapted for generating an output signal; and a surface signaling device adapted for receiving said output signal from said formation evaluation device and relaying said signals to a receiver located above ground level.

17. The device of claim 16 wherein:

said housing includes a longitudinal groove extending along a portion of an outer surface of said housing.

18. The device of claim 17 further including:

cable means extending along said longitudinal groove, said cable means interconnecting said formation evaluation device and said surface signaling device for transference of said signals therebetween.

19. The device of claim 16 wherein:

said housing includes a pressurized fluid flow from the surface to the downhole motor; and said surface signaling device includes means for pulsing said fluid flow, said surface signaling device including alternator means for generating electricity from said fluid flow.

20. The device of claim 19 wherein:

said formation evaluation device is energized by said alternator via said cable means.

21. The device of claim 16 wherein said downhole motor includes:

a stator mounted within said housing, said stator having a helically grooved inner surface;

a rotor disposed within said stator, said rotor having a grooved outer surface and adapted to rotate about the inside surface of said stator; and a flexible connector interconnecting said rotor and said drive shaft.

22. The device of claim .6 wherein said formation evaluation device includes:

transmitting means for transmitting in-phase, equal amplitude reference signals;

a transmitting antenna normally connected to said transmitting means;

sensing means for sensing said reference signals;

a pair of spaced receiving antennas connected to said sensing means; and microprocessor means for calculating a difference in phase and amplitude between said reference signals received by said receiving antennas.

23. The device of claim 17 wherein:

said surface signaling device is mounted within said housing and adjacent said downhole motor.

* * * * *